US005339591A

United States Patent [19]

Underdahl

[11] Patent Number: 5,339,591

[45] Date of Patent: Aug. 23, 1994

[54] SHUTTER WITH PIN-MOUNTED STATIONARY LOUVERS

[75] Inventor: Russell H. Underdahl, Arden Hills, Minn.

[73] Assignee: Pinecrest, Inc., Minneapolis, Minn.

[21] Appl. No.: 969,999

[22] Filed: Nov. 2, 1992

[51] Int. Cl.[5] ..... E06B 7/08

[52] U.S. Cl. ..... 52/473; 49/74.1; 49/92.1

[58] Field of Search ..... 49/74.1, 92.1, 80.1, 49/77.1, 79.1; 52/243.1, 473

[56] References Cited

U.S. PATENT DOCUMENTS

| | | | |
|---|---|---|---|
| D. 304,497 | 11/1989 | Briggs, Sr. . | |
| 165,812 | 7/1875 | Fletcher | 49/74.1 |
| 169,644 | 11/1875 | Johnston et al. . | |
| 188,908 | 3/1877 | Hopkins et al. . | |
| 229,226 | 6/1880 | Rolfe | 52/473 |
| 345,689 | 7/1886 | Hayes . | |
| 472,592 | 4/1892 | Swartz | 52/473 |
| 863,573 | 8/1907 | McCord | 49/74.1 |
| 3,691,687 | 9/1972 | Economou | 52/473 |
| 4,887,391 | 12/1989 | Briggs, Sr. . | |
| 4,974,362 | 12/1990 | Briggs, Sr. . | |
| 4,977,683 | 12/1990 | Harder | 353/73 |

FOREIGN PATENT DOCUMENTS

| | | | |
|---|---|---|---|
| 709239 | 5/1954 | United Kingdom | 52/243.1 |

*Primary Examiner*—James L. Ridgill, Jr.
*Attorney, Agent, or Firm*—Merchant, Gould, Smith Edell, Welter & Schmidt

[57] ABSTRACT

A shutter is disclosed having stationary louvers each mounted separately in a rectangular shutter frame by a plurality of side mounting pins. The side mounting pins in one embodiment of the invention on one side of the louver can be depressed to allow for insertion into the frame. This provides for easy insertion of louvers into separately manufactured frames for easy replacement of damaged louvers and louver pins.

10 Claims, 3 Drawing Sheets

SHUTTER WITH PIN-MOUNTED STATIONARY LOUVERS

BACKGROUND OF THE INVENTION

1. Field of the Invention

The present invention pertains to stationary shutters. More particularly, this invention pertains to shutters having stationary louvers inserted in a shutter frame by side mounting pins as opposed to gluing, or forming louver slots in the frame sides.

In addition, this invention adds an improved means for replacing damaged louvers and side mounting pins on shutters that need repair.

2. Description of Prior Art

Shutters having stationary louvers are well known. Shutters which employ pivoting louvers for selection of the amount of light admitted are also well-known. U.S. Pat. No. 4,974,362 pertains to a movable shutter having pivoting louvers. Each louver rotates on a single mounting pin on each end of the louver. The louvers are linked for shared movement.

The usual manufacturing procedure for louvered shutter assemblies is to bring together each of the side, top and bottom pieces for the rectangular frame to be formed as well as each of the plurality of louvers, which are combined in one step.

Stationary shutters are typically manufactured by cutting grooves or slots in the sides of the frame. The ends of the louvers are then slid into the grooves and the shutters are retained in the frame when the side portions are held together with top and bottom frame members against the ends of the louvers. This requires a substantial amount of machining to cut the grooves for the shutters. In addition, this method limits the shape of shutter that can be placed in the groove without having aesthetically unpleasing gaps formed where the groove is larger than the associated louvers. Decorative louvers having profiles which are not straight are difficult to mount in an aesthetically pleasing manner when mounted in grooves formed in the side frame members.

Further problems with forming grooves in the side frame members arise when a louver is damaged or broken and requires replacement. Since the louvers are wider than the distance between the side frame members, a louver cannot be placed in the groove formed in the side members of an assembled shutter. The shutter must be dismantled with the frame side members pulled apart, or the shutter cannot be repaired. Yet another problem occurs when the louver angle is very steep, as long louvers cannot be accommodated in the length of the grooves of the frame members.

Movable louvers which mount on a single pin at each end do not overcome the mounting problems for stationary shutters as the shutters must be maintained in a single position. The gluing of the louvers to prevent rotation often leads to glue being squeezed from between the end of the louver and the side frame members and requires cleaning or refitting.

Notwithstanding the long history of the design and modifications of shutters, there are continuing needs for improvements in shutter design, manufacturing and repair capabilities. It can be seen then that a louvers is needed which can be mounted in a stationary manner which does not require grooves to be cut in the side frame members. It can also be seen that a louver is needed which does not require gluing.

SUMMARY OF THE INVENTION

In accordance with the principles of the present invention, there is provided a shutter assembly including a frame defining a frame opening. A plurality of louvers are disposed longitudinally within the opening and are mounted in a stationary manner.

Each louver is mounted with at least one pin on both ends and at least one end having more than one pin extending therefrom. In this manner, each louver is prevented from rotation about the pins to remain in a stationary position. The side frame members have bores formed therein for receiving the pins and can be easily aligned to maintain the pins in the same orientation so that the louvers are all correctly aligned at the same angle.

In addition, the mounting pins may be spring-loaded pins which can be compressed so that the louvers can slide between the frame members for assembly. In this manner, when the pins are aligned with the bores of the side frame members, the spring forces the pin outward from its non-compressed state and the louver will be retained between the side frame members. It can be appreciated that broken or damaged louvers may be replaced utilizing spring-loaded mounting pins. In addition, should just a pin or just a louver be broken, the pin can be removed and a depressible mounting pin can be inserted therefore for replacing the louver without replacing the entire shutter assembly.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
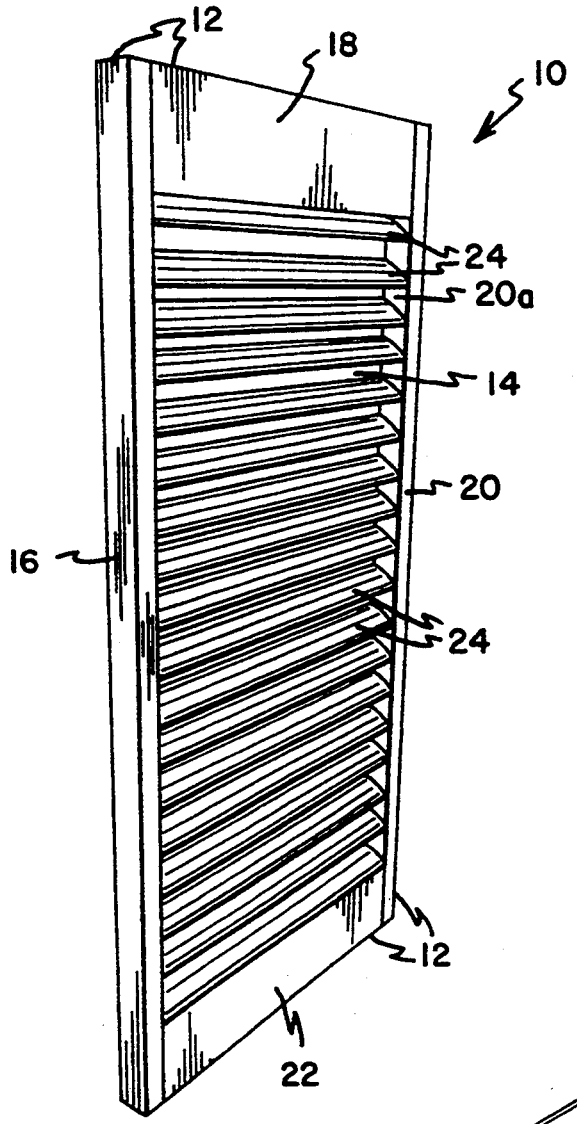
FIG. 1 shows a front perspective view of a shutter having stationary louvers constructed in accordance with the principles of the present invention.

A shutter assembly 10 constructed in accordance with the invention is depicted in the drawings. As shown in FIG. 1, the shutter 10 includes a rectangular frame 12, preferably formed from wood, although other materials may be used, including parallel and spaced apart bottom and top horizontal rails 18 and 22 and parallel and spaced apart side rails 16 and 20, forming a frame opening 14. A plurality of stationary louvers 24, each of which are typically identical, are disposed horizontally within the frame opening 14. The louvers 24 have a longitudinal length which is sized to generally extend between the inner peripheral edges 16*a*, 20*a* of side rails 16, 20 shown in FIGS. 3 and 4. A transverse length of the louvers 24 extends between a leading edge 25 and a trailing edge 27, as shown in FIG. 2.

Figure 4:
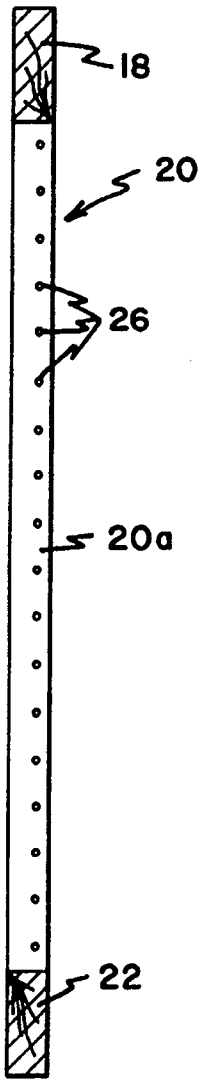
FIG. 4 shows a sectional view of the right side frame member and the top and bottom frame members.
Figure 3:
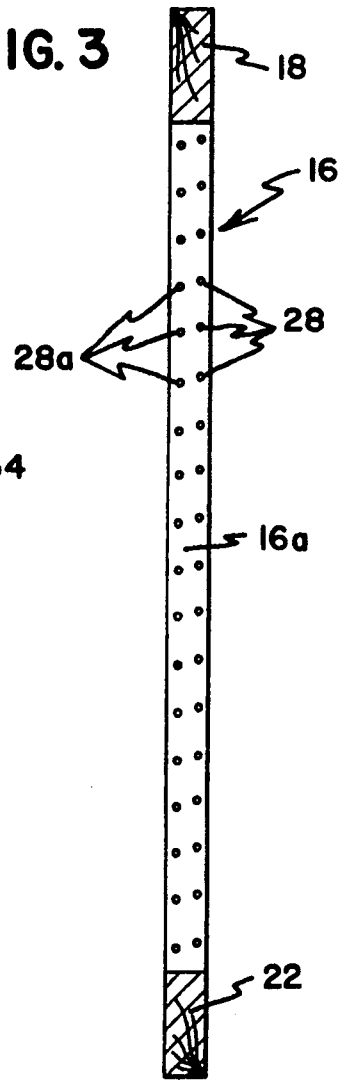
FIG. 3 shows a sectional view of the left side frame member and the top and bottom frame members.

As shown in FIGS. 3 and 4, the frame side rail members 16, 20 are provided with mounting holes or bores 26, 28 on the inner peripheral edges 16*a* , 20*a* for receiving each louver 24. Each louver 24 has mounting pins 30 inserted into the louver ends which snugly engage the louver holes 26, 28 to position the louver 24 at an angle defined by holes 28 and 28*a* in the inner peripheral edge 16*a* of the side frame member 16.

Figure 2:
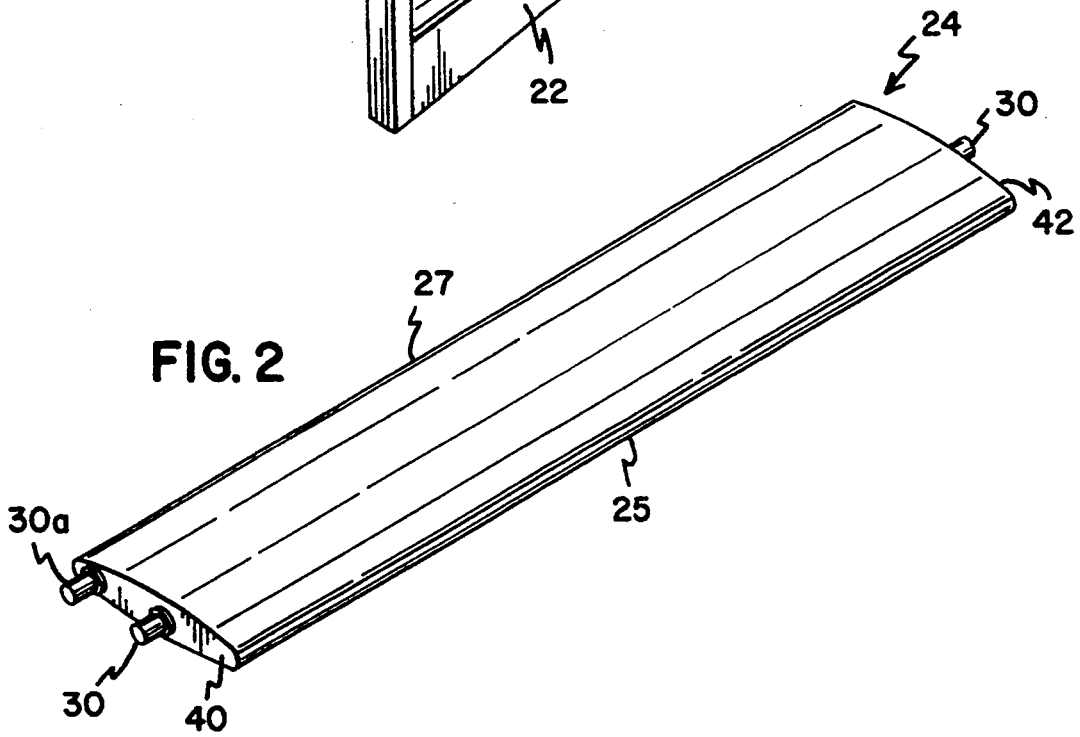
FIG. 2 shows a top perspective view of a louver having two side mounting pins on a first end portion and one side mounting pin on a second end portion of the louver.
Figure 7:
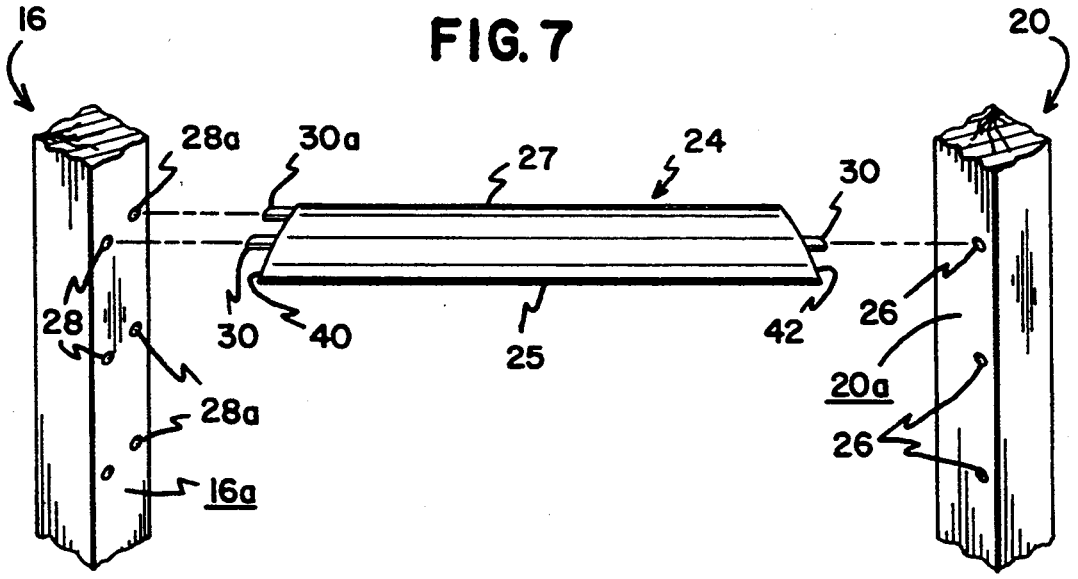
FIG. 7 shows an exploded view of a louver and the frame side members.

As shown in FIG. 2, at least one end 40 includes the mounting pin 30 and a second mounting pin 30*a* in the preferred embodiment. The second mounting pin 30*a* prevents the louver 24 from pivoting or rotating about the pins 30. The mounting pins 30*a* are preferably placed toward the trailing edge 27 of the louver 24. As shown in FIG. 7, the pins 30 insert into first bores 26 and 28 in the side frame members 16 and 20. The second pin 30*a* inserts into a second bore 28*a* aligned with an associated bore 28 so that the louver 24 is angled. It can be appreciated that by having two pins, 30 and 30*a* , inserting into two bores 28 and 28*a* , at one or both ends of each louver 24, the louver will be held in a stationary position when mounted. Although only one end has two pins 30 and 30*a* in the embodiment shown, it can be appreciated that both ends may have two pins. It can also be appreciated that more than two pins may be utilized at one or both ends to prevent movement of the louver 24.

Figure 5:
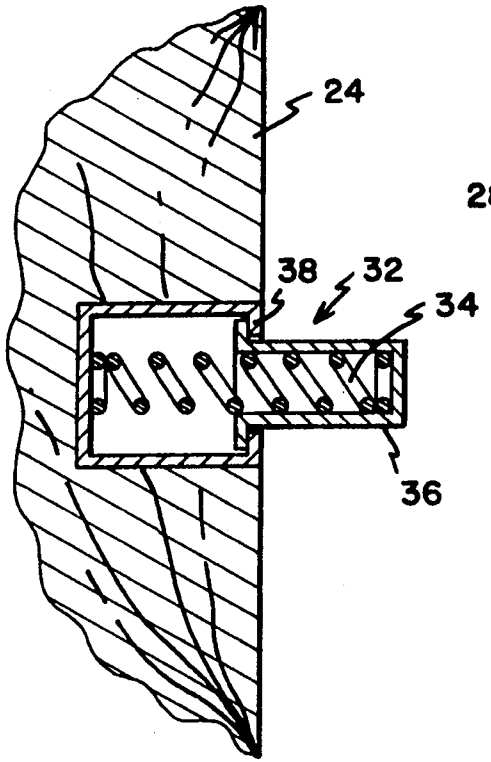
FIG. 5 shows a sectional view of a detail of a spring loaded mounting pin in an extended position.
Figure 6:
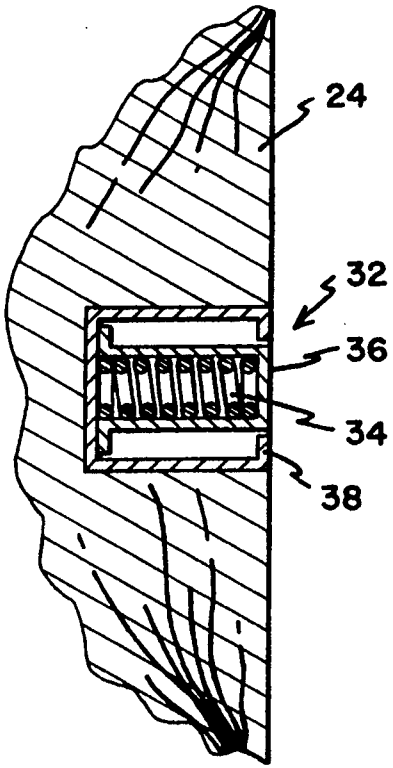
FIG. 6 shows a sectional view of a detail of a spring loaded mounting pin in a compressed position.

The shutter 10 utilizes conventional pins 30 in the preferred embodiment. However, depressible pins 32, shown in FIGS. 5 and 6 may be utilized in replacement louvers. The depressible mounting pin 32 is spring activated, including two nesting hollow cylinders 36, 38, and a spring 34 intermediate the hollow cylinders 36, 38. The depressible mounting pin 32 allows for the portion of the mounting pin 32 extending from the louver end portions 40, 42, to be completely contained by the louver 24 when depressed, no longer extending from the louver end portions 40, 42, as shown in FIG. 6. The depressible mounting pins 32 allow for replacement of the stationary louvers 24 in an already constructed rectangular frame 12.

The resulting shutter from the foregoing description is one with substantial advantages over presently available shutters. The mounting pins 30 allow for easier assembly of stationary louvers, by replacing the steps of sawing louver slots in the side frame and gluing the louver into the slots for louver replacement. The mounting pins 30 also allow for shutters to be made with decorative louvers by permitting louvers with ornamental shapes to be placed in shutter frames with end portions flush against the side frame members. In the past, this was very difficult to do with the methods using louver slots and gluing, as the carving of slots became very complicated or was impossible. In addition, the mounting pins 30 in stationary shutters provide for easier replacing of damaged louvers and side mounting pins on shutters that need repair. When the mounting pin or pins 32 at one or both ends of a louver are spring loaded depressible, louvers 24 can be replaced with the frame 12 still intact.

Through the foregoing detailed description of the present invention, it has been shown how the present invention has been achieved in a preferred manner. However, modifications such as those which readily occur to one skilled in the art, are intended within the scope of the present invention.

What is claimed is:

1. A shutter, comprising:

a frame including means defining a frame opening, wherein said frame includes first and second side members;

a plurality of stationary louvers disposed within said opening, each of said plurality of louvers including first and second end portions;

mounting pins extending from each of said first and second louver end portions, wherein each of said side members include bores for receiving said mounting pins; and means for removing and replacing said stationary louvers after said frame is assembled.

2. A shutter according to claim 1, wherein each of said louvers includes a longitudinal dimension extending between said first and second side members of said frame, wherein said first end portions of said louvers have one mounting pin extending longitudinally engaging said bores of said first side member, and wherein said second end portions of said louvers have at least two mounting pins extending longitudinally engaging said bores of said second side members, wherein said mounting pins at said louver first end portion are spring loaded and depressible.

3. A shutter according to claim 1, wherein each of said louvers includes a longitudinal dimension extending between said first and second side members of said frame, wherein at least one of said end portions of each of said louvers includes a plurality of mounting pins extending longitudinally engaging said bores of said first and second side members, wherein said mounting pins are spring loaded and depressible.

4. A shutter according to claim 3, wherein said spring loaded depressible mounting pin can be depressed to a point at which said mounting pin is completely engulfed by said louver end portions thereby no longer extending from said end portions and providing said means for removing and replacing said stationary louvers.

5. A shutter according to claim 3, wherein said spring loaded mounting pin comprises two hollow cylinders and a spring intermediate said hollow cylinders, wherein each of said hollow cylinders comprises a cylindrical wall with a first end capped and a second end open, wherein said first cylinder includes dimensions which are selectively configured for placing said first cylinder inside said second cylinder, and wherein said capped ends of said first and second cylinders are opposed with said spring intermediate said first and second capped ends.

6. A shutter according to claim 5, wherein said first and second hollow cylinders include an annular rim on said open end of said hollow cylinder opposing said capped end, wherein said annular rim on said first cylinder extends radially outward, wherein said annular ring on said second cylinder extends radially inward, and wherein said annular rims of said first and second cylinders engage, thereby preventing their separation.

7. A shutter, comprising:

a frame including means defining a frame opening, wherein said frame includes first and second side members, wherein said first and second side members include bores;

a plurality of stationary louvers disposed within said opening, each of said plurality of louvers including first and second end portions wherein said end portions include bores;

spring loaded depressible mounting pins placed within said first and second louver end portion bores, wherein said spring loaded mounting pins extend longitudinally and engage said bores of said first and second side members;

said spring loaded depressible mounting pins comprising first and second hollow cylinders and a spring intermediate said hollow cylinders, wherein each of said hollow cylinders comprises a cylindrical wall with a first end capped and a second end open, wherein said first cylinder includes dimensions selectively configured for placing said first cylinder inside said second cylinder, and wherein said capped ends of said first and second cylinders are opposed with said spring intermediate said first and second capped ends; and, means for removing and replacing said stationary louvers after said frame is assembled.

8. A shutter according to claim 7, wherein each of said louvers includes a longitudinal dimension extending between said first and second side members of said frame, wherein said first end portions of said louvers having one spring loaded mounting pin extending longitudinally engaging said bores of said first side member, and wherein said second end portions of said louvers have at least two spring loaded mounting pins extending longitudinally engaging said bores of said second side members.

9. A shutter according to claim 7, wherein said first and second hollow cylinders include an annular rim on said open end of said hollow cylinder opposing said capped end, wherein said annular rim on said first cylinder extends radially outward, wherein said annular rim on said second cylinder extends radially inward, and wherein said annular rims of said first and second cylinders engage, thereby preventing their separation.

10. A replaceable louver for engaging a shutter frame comprising:

a longitudinal dimension extending between side members of the shutter frame;

a first end portion;

a second end portion; and a plurality of spring loaded depressible mounting pins, wherein said spring loaded depressible mounting pins comprise first and second hollow cylinders and a spring intermediate said hollow cylinders, wherein each of said hollow cylinders comprises a cylindrical wall with a first end capped and a second end open, wherein said first cylinder includes dimensions which are selectively configured for placing said first cylinder inside said second cylinder, and wherein said capped ends of said first and second cylinders are opposed with said spring intermediate said first and second capped ends, wherein said first and second hollow cylinders include an annular rim on said open end of said hollow cylinder opposing said capped end, wherein said annular rim on said first cylinder extends radially outward, wherein said annular rim on said second cylinder extends radially inward, and wherein said annular rims of said first and second cylinders engage, thereby preventing their separation, wherein said first and second louver end portions include bores for receiving said depressible mounting pins, wherein said first hollow cylinder engages said louver end portion bores and said second hollow cylinder engages bores within the shutter frame.

* * * * *